US011353032B2

(12) United States Patent
Uchino et al.

(10) Patent No.: US 11,353,032 B2
(45) Date of Patent: Jun. 7, 2022

(54) AIR BLOWER

(71) Applicant: Nidec Corporation, Kyoto (JP)

(72) Inventors: Takashi Uchino, Kyoto (JP); Yukinobu Shiraishi, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 0 days.

(21) Appl. No.: 17/015,885

(22) Filed: Sep. 9, 2020

(65) Prior Publication Data

US 2021/0095679 A1 Apr. 1, 2021

(51) Int. Cl.

| | |
|---|---|
| ***F04D 25/06*** | (2006.01) |
| ***F04D 25/08*** | (2006.01) |
| ***F04D 17/16*** | (2006.01) |
| ***F04D 29/42*** | (2006.01) |

(52) U.S. Cl.

CPC ..... *F04D 25/0693* (2013.01); *F04D 17/16* (2013.01); *F04D 25/08* (2013.01); *F04D 29/4226* (2013.01); *F05B 2240/14* (2013.01); *F05B 2240/85* (2020.08)

(58) Field of Classification Search

CPC .. F04D 29/4226; F04D 29/281; F04D 29/703; F04D 29/603; F04D 29/626

See application file for complete search history.

(56) References Cited

U.S. PATENT DOCUMENTS 5,350,281 A * 9/1994 Hagshenas ..... F04D 25/082 415/144
8,297,950 B2 * 10/2012 Horng ..... F04D 25/0653 417/423.14
8,979,513 B2 * 3/2015 Yen ..... F04D 25/0693 417/423.14
10,288,084 B2 * 5/2019 Lofy ..... F04D 17/08
10,408,216 B2 * 9/2019 Takeshita ..... F04D 25/0693
2008/0304986 A1 * 12/2008 Kenyon ..... H02K 5/24 417/423.12
2009/0263242 A1 * 10/2009 Winkler ..... F04D 25/0693 415/213.1
2017/0125939 A1 * 5/2017 Relue ..... H01R 13/567
2017/0224940 A1 * 8/2017 Kenyon ..... A61M 16/0605
2019/0178261 A1 * 6/2019 Kajikawa ..... H02K 9/06
2019/0277305 A1 * 9/2019 Chen ..... F04D 17/162
2019/0331130 A1 * 10/2019 Lofy ..... F04D 29/281

FOREIGN PATENT DOCUMENTS

JP 2004-064849 A 2/2004

* cited by examiner

*Primary Examiner* — Dominick L Plakkoottam
(74) *Attorney, Agent, or Firm* — Keating & Bennett

(57) ABSTRACT

An air blower includes an impeller, a motor, a lead wire, and a casing. The impeller rotates around a central axis extending in a vertical direction. The motor rotates the impeller. The lead wire is connected to the motor. The casing houses the impeller and the motor. The casing includes a bottom plate portion, a side wall portion, and a top plate portion. The top plate portion is disposed axially above the impeller and is connected to the upper end of the side wall portion. The casing includes a lead-out port through which the lead wire is led out to the outside in the radial direction. The lead-out port includes a lower portion provided on the bottom plate portion and an upper portion provided on the side wall portion, and the lower and upper portions are defined by different members.

10 Claims, 6 Drawing Sheets

【Fig. 1】
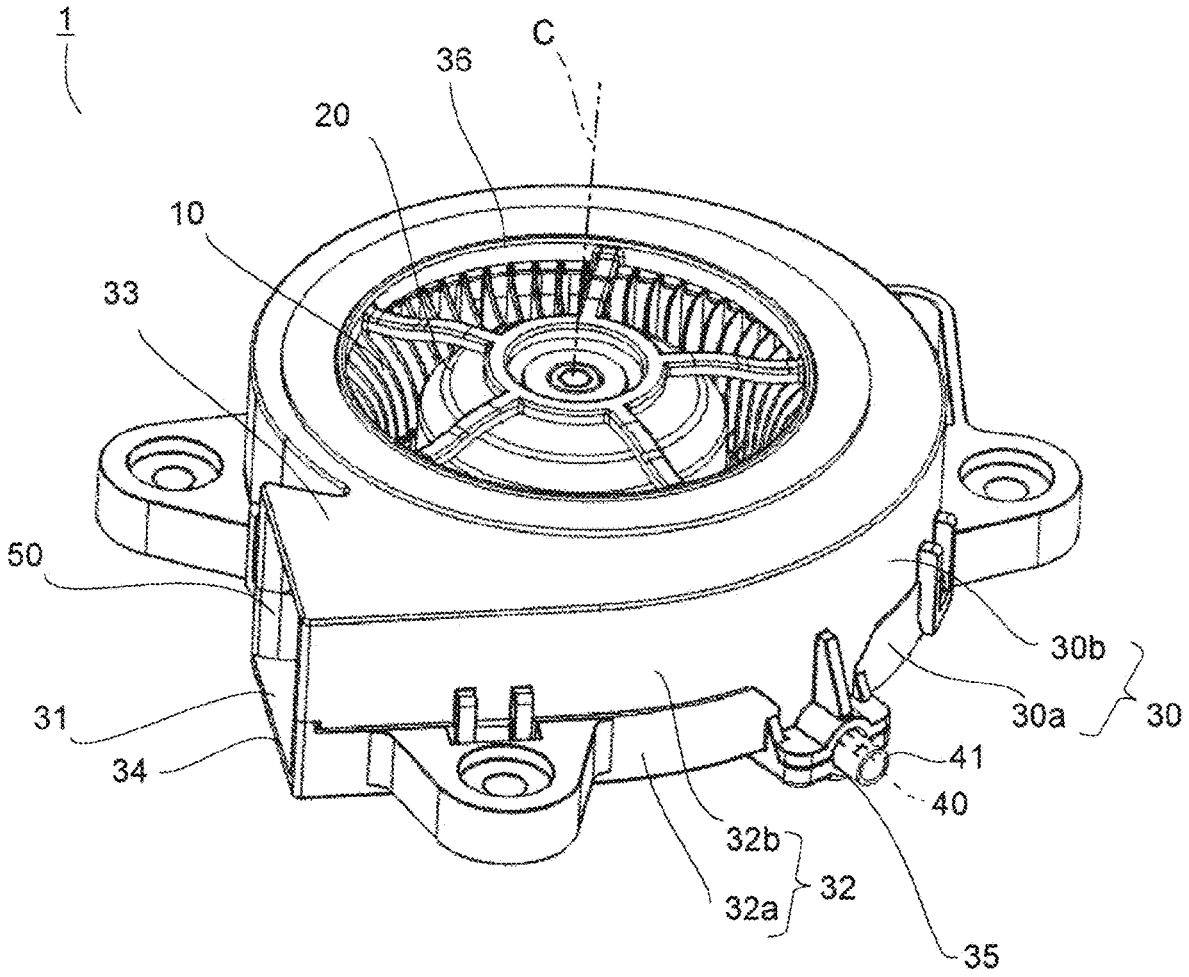

【Fig. 2】
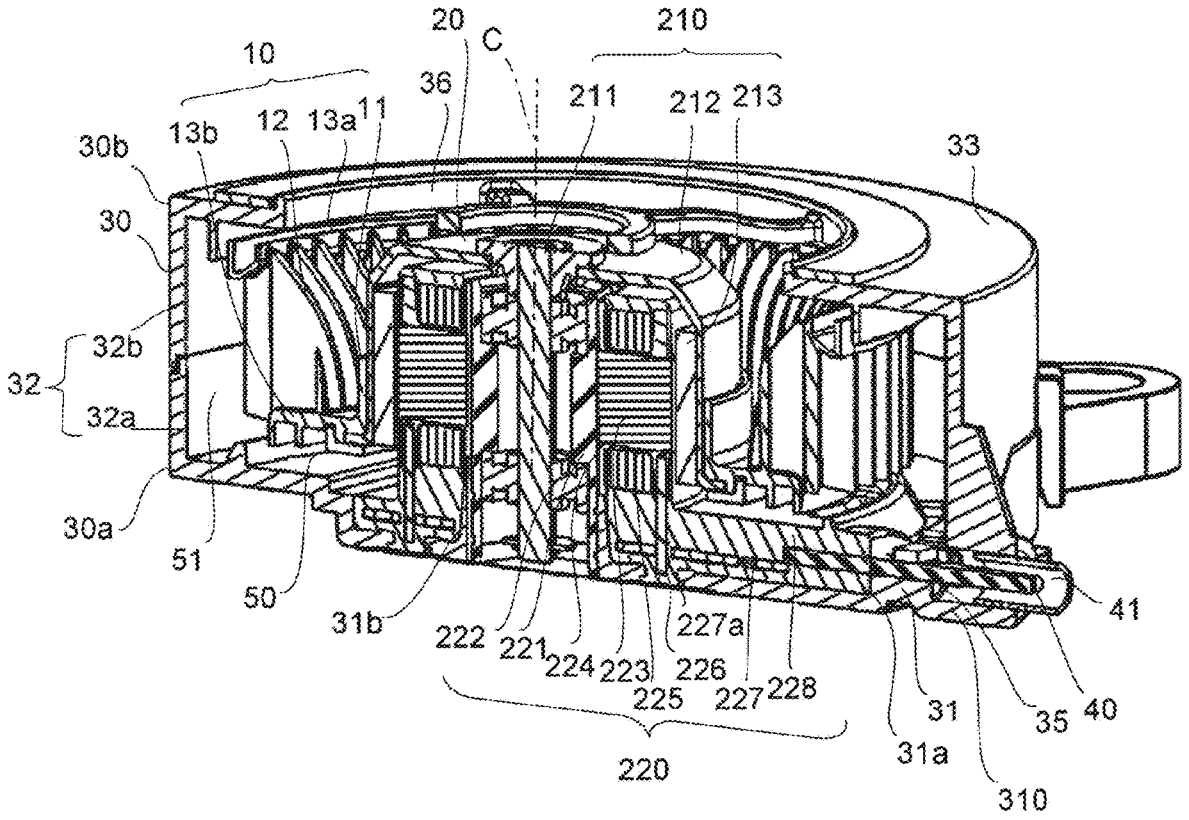

【Fig. 3】
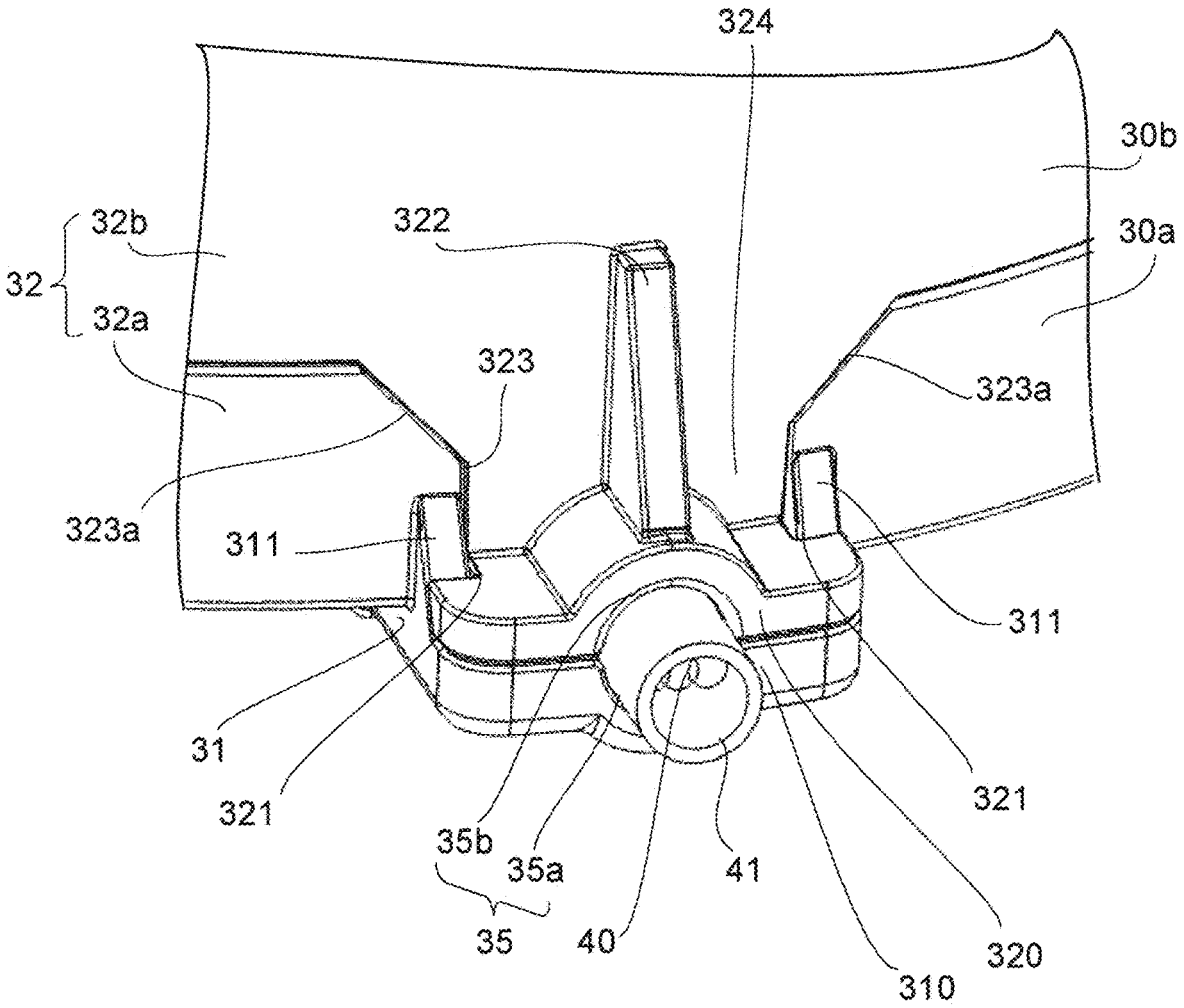

【Fig. 4】
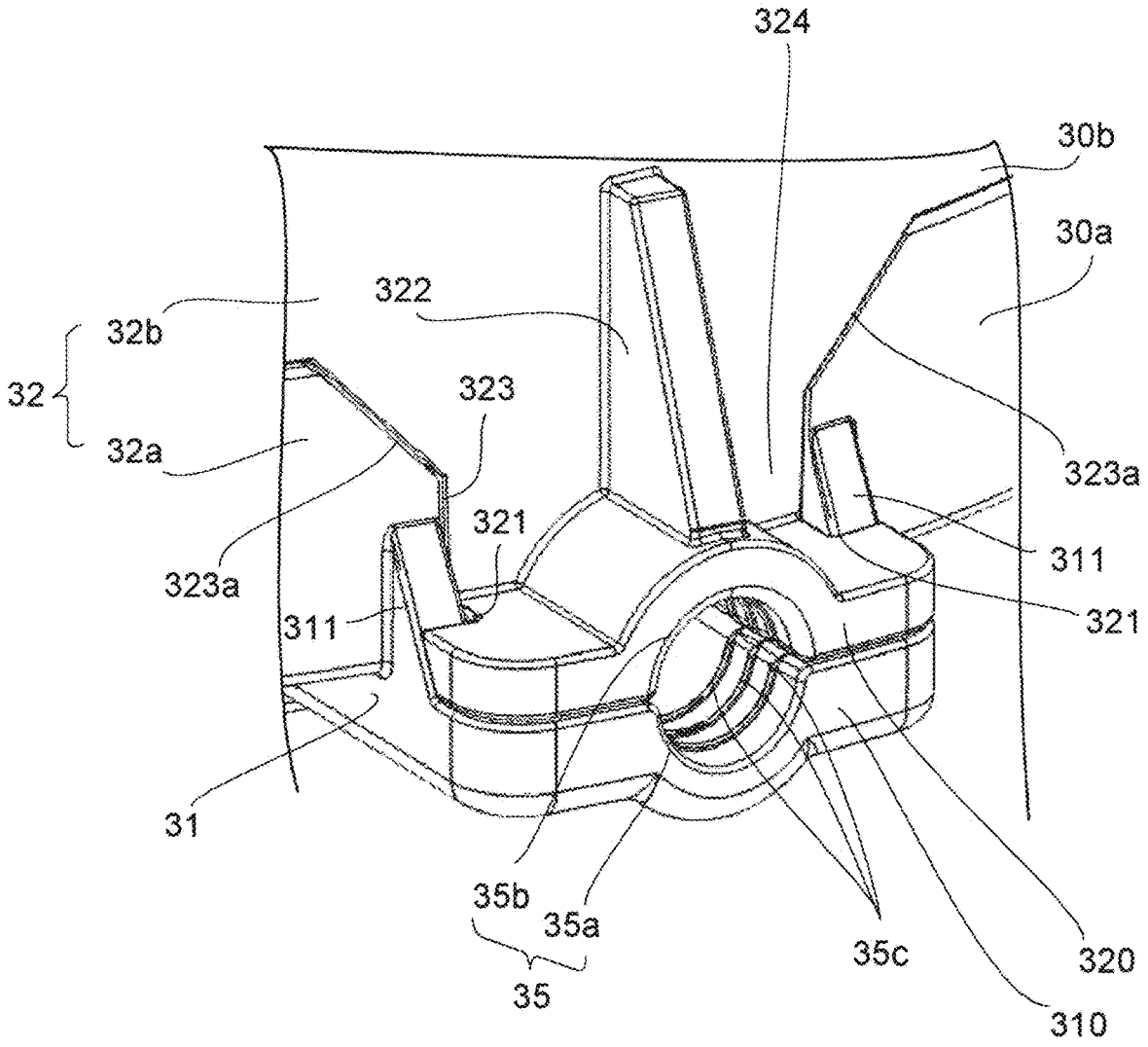

【Fig. 5】
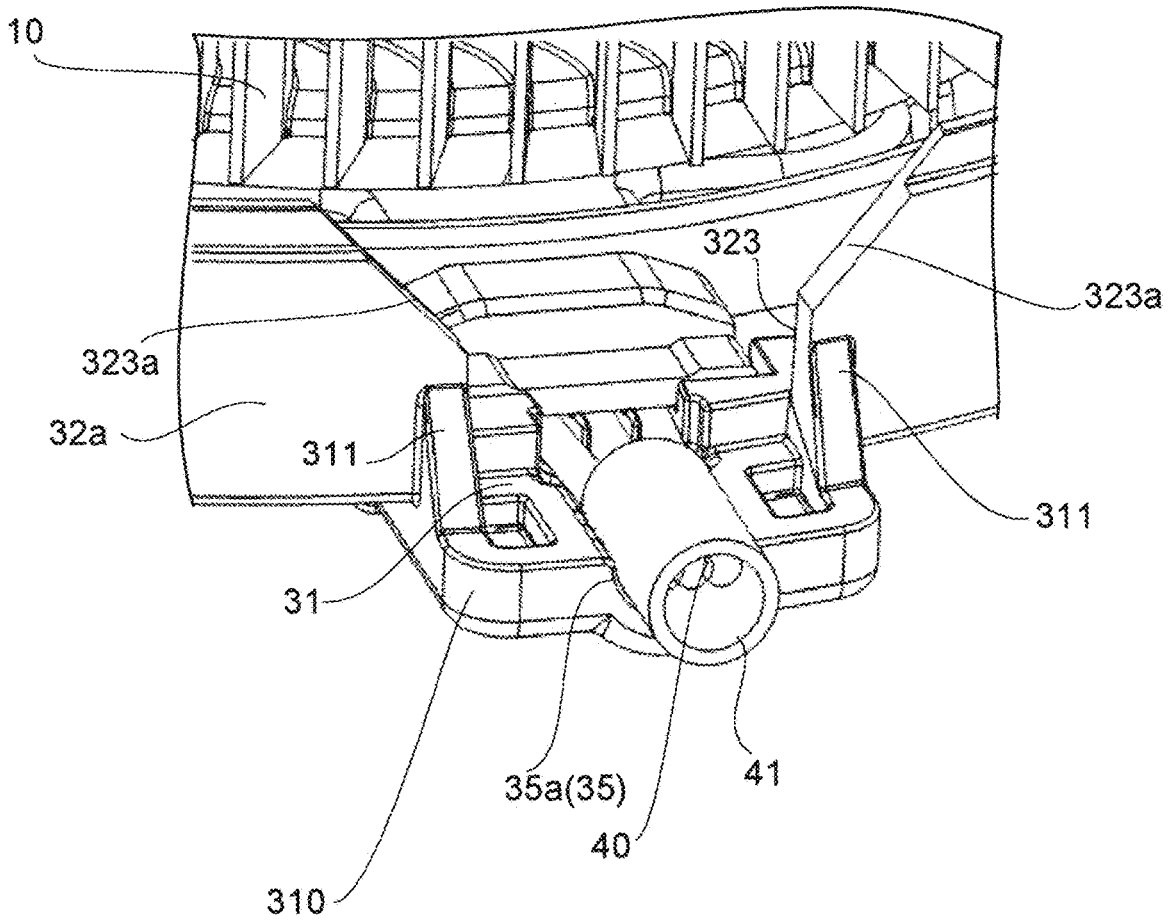

【Fig. 6】
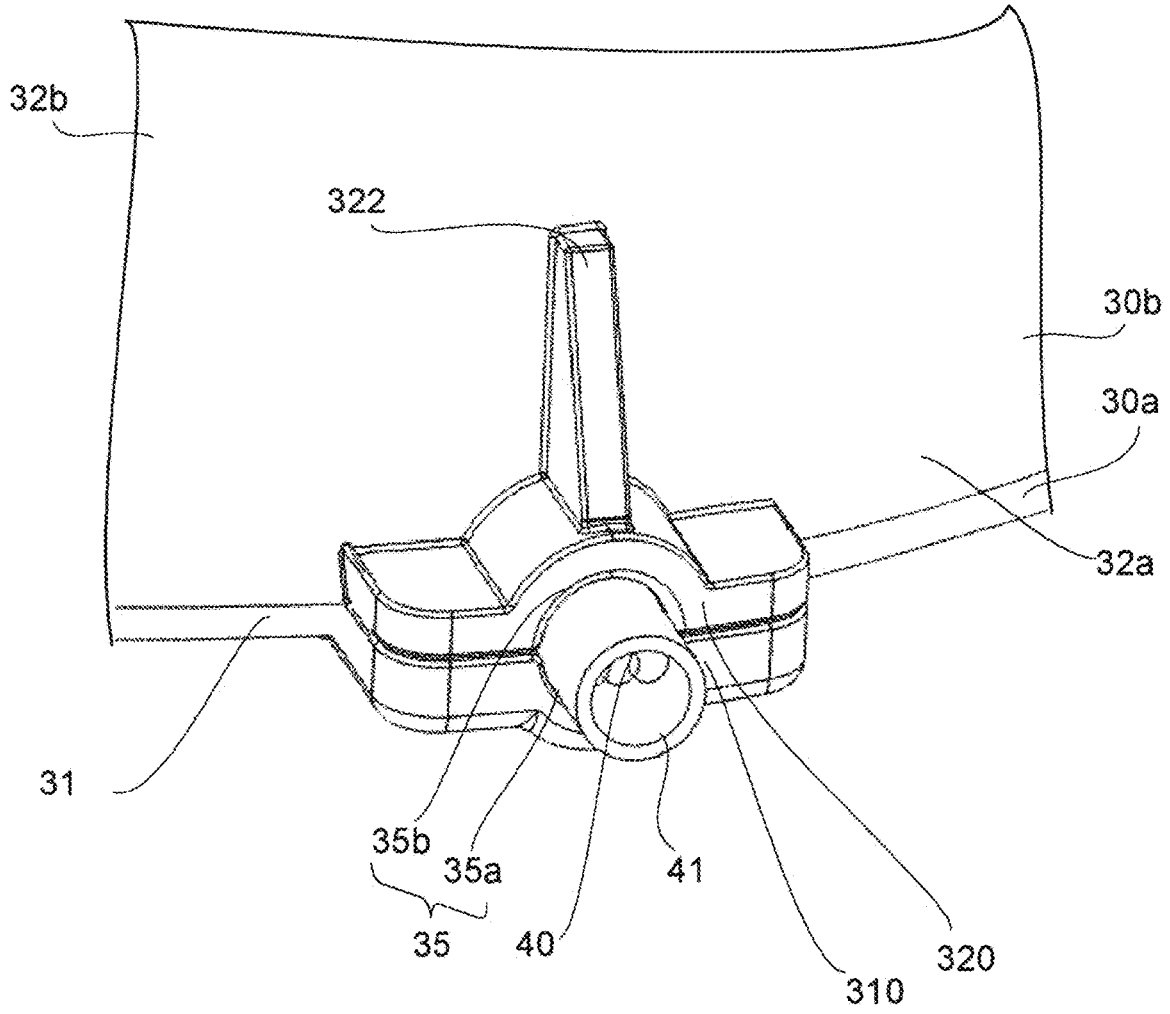

AIR BLOWER

CROSS REFERENCE TO RELATED APPLICATION

The present application claims priority under 35 U.S.C. § 119 to Japanese Application No. 2019-176159 filed on Sep. 26, 2019, the entire contents of which are hereby incorporated herein by reference.

1. FIELD OF THE INVENTION

The present disclosure relates to an air blower.

2. BACKGROUND

A conventional air blower includes, for example, a vane wheel and a motor. The motor rotates the vane wheel. The rotor and the stator of the motor are covered by an outer shell. The outer shell includes a frame, a bracket, and a protective cover. The frame covers the lower portion of the motor and the bracket covers the upper portion of the motor. The protective cover covers a lead-out portion that is an opening in the peripheral surface of the frame. A lead wire connected to the motor is led out through the lead-out portion to the outside of the bracket and then bends and extends downward in the axial direction.

In the conventional air blower, a lead wire is bent and led out to the outside of the outer shell, causing poor assembly efficiency. In addition, the lead wire may be damaged when the lead wire is bent.

SUMMARY

An air blower according to an example embodiment of the present disclosure includes an impeller, a motor, a lead wire, and a casing. The impeller rotates around a central axis extending in a vertical direction. The motor rotates the impeller. The lead wire is connected to the motor. The casing houses the impeller and the motor. The casing includes a bottom plate portion, a side wall portion, and a top plate portion. The bottom plate portion expands from the central axis in the radial direction and holds the motor on the upper surface of the bottom plate portion. The side wall portion extends axially upward from the outer peripheral portion of the bottom plate portion. The top plate portion is disposed axially above the impeller and is connected to the upper end of the side wall portion. The casing includes a lead-out port through which the lead wire is led out to the outside in the radial direction. The lead-out port includes a lower portion provided on the bottom plate portion and an upper portion provided on the side wall portion, and the lower and upper portions are defined by different members.

The above and other elements, features, steps, characteristics and advantages of the present disclosure will become more apparent from the following detailed description of the example embodiments with reference to the attached drawings.

BRIEF DESCRIPTION OF THE DRAWINGS

FIG. 1 is a perspective view of an air blower according to an example embodiment of the present disclosure.

FIG. 2 is a perspective sectional view of an example embodiment of the present disclosure.

FIG. 3 is an enlarged perspective view illustrating a portion of a casing of an air blower of an example embodiment of the present disclosure.

FIG. 4 is an enlarged perspective view illustrating a portion of a casing of an air blower according to an example embodiment of the present disclosure.

FIG. 5 is an enlarged perspective view illustrating a portion of a casing of an air blower according to an example embodiment of the present disclosure.

FIG. 6 is a perspective view illustrating a modification of a portion of a casing of an air blower according to an example embodiment of the present disclosure.

DETAILED DESCRIPTION

Hereinafter, example embodiments of the present disclosure will be described in detail with reference to the drawings. In the present specification, a direction parallel to a central axis C of an air blower 1 is referred to as an "axial direction", a direction perpendicular to the central axis C of the air blower 1 is referred to as a "radial direction", and a direction along a circular arc centered on the central axis C of the air blower 1 is referred to as a "circumferential direction". In this specification, the shape and the positional relationship of each component will be described on the assumption that an axial direction is the vertical direction and a circuit board side with respect to a stator core is a lower side. The vertical direction is merely referred for description, and does not limit the actual positional relationship or direction.

An air blower of an example embodiment of the present disclosure will be described. FIGS. 1 and 2 are a perspective view and a perspective sectional view of the air blower 1 according to the example embodiment of the present disclosure, respectively.

The air blower 1 includes an impeller 10, a motor 20, lead wires 40, and a casing 30, and the casing 30 houses the impeller 10 and the motor 20. The motor 20 is disposed inside the impeller 10 and rotates the impeller 10 around the central axis C. The lead wires 40 are connected to the motor 20, and electrically connect the motor 20 and a device outside the casing 30.

The casing 30 has an intake port 36 in the upper surface and an outlet 34 in the side surface. In addition, a duct 50 that connects the intake port 36 and the outlet 34 is formed in the casing 30, and the impeller 10 and the motor 20 are disposed in the duct 50. The duct 50 has a ring-shaped airflow path 51 radially outside the impeller 10. The outlet 34 is disposed at the downstream end of the airflow path 51. The air blower 1 sucks air through the intake port 36 and sends an airflow through the outlet 34 in the radial direction.

The casing 30 includes a base portion 30*a* and a cover portion 30*b*, which are formed separately by separate members. The base portion 30*a* supports the motor 20, and the cover portion 30*b* covers the axially upper side of the impeller 10.

The base portion 30*a* includes a bottom plate portion 31 and a lower wall portion 32*a*. The bottom plate portion 31 is disposed axially below the impeller 10 and the motor 20, and expands from the central axis C in the radial direction. The bottom plate portion 31 includes a bottom plate recess portion 31*a* and a bottom plate cylindrical portion 31*b*. The bottom plate recess portion 31*a* is recessed axially downward from the upper surface. The bottom plate cylindrical portion 31*b* is disposed radially inside the bottom plate recess portion 31*a* to have a cylindrical shape surrounding the central axis C, and extends axially upward. The lower wall portion 32*a* projects axially upward from the radially outer end portion of the bottom plate portion 31 and extends in the circumferential direction.

The cover portion 30*b* includes a top plate portion 33 and an upper wall portion 32*b*. The top plate portion 33 is disposed axially above the impeller 10 and expands in the radial direction. The top plate portion 33 has the intake port 36 penetrating therethrough in the axial direction. The upper wall portion 32*b* projects axially downward from the radially outer end portion of the top plate portion 33 and extends in the circumferential direction. The lower end of the upper wall portion 32*b* and the upper end of the lower wall portion 32*a* are in contact with each other to form a side wall portion 32 of the casing 30.

That is, the casing 30 includes the bottom plate portion 31, the top plate portion 33, and the side wall portion 32. The bottom plate portion 31 expands in the radial direction from the central axis C and holds the motor 20 on the upper surface. The side wall portion 32 extends axially upward from the outer peripheral portion of the bottom plate portion 31. The top plate portion 33 is disposed axially above the impeller 10 and is connected to the upper end of the side wall portion 32. The side wall portion 32 is axially divided and includes the lower wall portion 32*a* connected to the bottom plate portion 31 and the upper wall portion 32*b* connected to the top plate portion 33. The duct 50 is defined by the bottom plate portion 31, the side wall portion 32, and the top plate portion 33.

The side wall portion 32 has the outlet 34 penetrating therethrough in the radial direction. The axially upper portion of the outlet 34 is formed by the upper wall portion 32*b*, and the axially lower portion of the outlet 34 is formed by the lower wall portion 32*a*.

The casing 30 has a lead-out port 35 penetrating therethrough in the radial direction. The lead wires 40 are led out to the outside in the radial direction through the lead-out port 35. The structure of the lead-out port 35 will be described below in detail.

The impeller 10 is driven by the motor 20 to rotate around the central axis C extending in the vertical direction. As a result, the air sucked through the intake port 36 is sent outward in the radial direction as an airflow.

The impeller 10 includes a cylindrical portion 11, blades 12, an upper connection portion 13*a*, and a lower connection portion 13*b* that are integrally made of resin.

The cylindrical portion 11 has a cylindrical shape extending in the axial direction, and a rotor holder 212 of the motor 20 to be described below fits inside the cylindrical portion 11. The lower connection portion 13*b* extends outward in the radial direction from the lower end portion of the cylindrical portion 11 to have a ring shape. The plurality of blades 12 is arranged in the circumferential direction, and the lower end portion of each blade 12 is connected to the lower connection portion 13*b*. The upper end portion of each blade 12 is connected to the ring-shaped upper connection portion 13*a*.

The motor 20 is a drive apparatus that rotationally drives the impeller 10. The motor 20 includes a rotor 210 and a stator 220. The rotor 210 includes a shaft 211, the rotor holder 212, and magnets 213. The shaft 211 is a columnar metal member that extends along the central axis C and defines a rotation axis. The upper end portion of the shaft 211 is connected to the rotor holder 212.

The rotor holder 212 has a lidded cylindrical shape, and the magnets 213 are fixed to the radially inner surface. The magnets 213 are disposed to face the radially outer side of the stator 220. The magnets 213 are arranged such that the S poles and N poles are alternately disposed in the circumferential direction.

The stator 220 includes a bearing housing 221, bearing portions 222, a stator core 223, an insulator 224, a coil 225, a terminal pin 226, a circuit board 227, and a mold portion 228.

The bearing housing 221 is formed to have a cylindrical shape and is held by the bottom plate cylindrical portion 31*b*. That is, the bottom plate portion 31 holds the motor 20 on the upper surface. The bearing housing 221 holds the two bearing portions 222. The bearing portions 222 rotatably support the shaft 211. As each of the bearing portions 222, a ball bearing is used, for example.

The stator core 223 surrounds the central axis C and is disposed radially outside the bearing housing 221. The stator core 223 is formed of a plurality of ring-shaped steel plates for lamination that are laminated in the axial direction.

The insulator 224 is formed of an insulating resin molded article and covers a part of the stator core 223.

The coil 225 is formed by winding a conductive wire (not illustrated) around the stator core 223 with the insulator 224 interposed therebetween. The insulator 224 insulates the stator core 223 from the conductive wire.

The terminal pin 226 extends in the axial direction and is connected to the conductive wire of the coil 225. The lower end portion of the terminal pin 226 is inserted into a through hole 227*a* formed in the circuit board 227 and soldered to the circuit board 227.

The circuit board 227 is disposed axially below the stator core 223, and is disposed in the bottom plate recess portion 31*a*. The lead wires 40 are electrically connected to the upper surface of the circuit board 227. The lead wires 40 are led out from the inside of the casing 30 through the lead-out port 35.

At this time, the upper surface of the bottom plate portion 31 radially outside the bottom plate recess portion 31*a* is disposed at substantially the same height as the upper surface of the circuit board 227. As a result, the lead wires 40 connected to the upper surface of the circuit board 227 can be led out to the outside in the radial direction while being supported by the bottom plate portion 31 without being bent in the axial direction. Therefore, damage to the lead wires 40 can be prevented.

The mold portion 228 covers the stator core 223, the insulator 224, the coil 225, the terminal pin 226, the circuit board 227, the lead wires 40, and the surface of the bottom plate portion 31. The mold portion 228 is formed by disposing a mold surrounding the radially outer side of the bottom plate recess portion 31*a* on the bottom plate portion 31 with the stator 220 fixed to the bottom plate cylindrical portion 31*b*, and filling the mold with molten mold resin. As the mold resin, for example, a thermoplastic resin material such as polyamide is used.

At this time, the mold resin flows between the circuit board 227 and the bottom plate recess portion 31*a*, and the circuit board 227 is firmly fixed to the bottom plate portion 31 through the mold portion 228. In addition, the connection portion between the circuit board 227 and the lead wires 40 is covered by the mold portion 228 to be protected from water and dust. Furthermore, the mold portion 228 makes the bottom plate recess portion 31*a* filled with the mold resin, so that the unevenness of the inner surface of the duct 50 is reduced, and the airflow in the duct 50 smoothly flows. Therefore, the blowing efficiency of the air blower 1 can be improved.

FIGS. 3 to 5 are enlarged perspective views illustrating a part of the casing 30, FIG. 4 illustrates the part without the lead wires 40, and FIG. 5 illustrates the part in a state where the cover portion 30*b* is removed. The lower wall portion 32*a* has a side wall cutout portion 323, which is defined by cut out downward in the axial direction from the upper end to open the upper end of the lower wall portion 32*a*. The lower end of the side wall cutout portion 323 is positioned on a lower projecting piece 310 of the bottom plate portion 31 (see FIG. 5). The upper wall portion 32*b* includes a side wall projecting portion 324, which projects axially downward and fits into the side wall cutout portion 323.

An axially lower portion of the lead-out port 35 is provided on the bottom plate portion 31 forming the base portion 30*a*. The axially upper portion of the lead-out port 35 is provided on the side wall projecting portion 324 of the upper wall portion 32*b* forming the cover portion 30*b*. As a result, in the state in which the cover portion 30*b* is removed from the base portion 30*a*, the side wall projecting portion 324 is disengaged from the side wall cutout portion 323, and the axially upper portion of the lead-out port 35 is released.

That is, the lower portion of the lead-out port 35 provided on the bottom plate portion 31 and the upper portion of the lead-out port 35 provided on the side wall portion 32 are formed by different members. Since the axially lower portion of the lead-out port 35 is provided on the bottom plate portion 31, the axially upper portion of the lead-out port 35 can be released, so that the lead wires 40 can be led out to the outside in the radial direction along the bottom plate portion 31 without being bent in the axial direction. Therefore, damage to the lead wires 40 can be prevented.

The lower wall portion 32*a* has a pair of inclined portions 323*a* on both end surfaces facing each other in the circumferential direction with the side wall cutout portion 323 interposed therebetween, and the inclined portions 323*a* are closer to each other at lower positions in the axial direction from the upper end. The lead wires 40 in a state of being connected to the circuit board 227 are attached to the base portion 30*a* together with the stator 220. At this time, the lead wires 40 are fitted into the lead-out port 35 while being lowered in the axial direction from the axial upper side of the side wall cutout portion 323. The inclined portions 323*a* facilitates guide of the lead wires 40 to the lead-out port 35. In addition, it is possible to prevent fingers from being hurt by touching the upper ends of the lower wall portion 32*a*, which would face each other in the circumferential direction with the side wall cutout portion 323 interposed therebetween. Therefore, the assembly efficiency of the air blower 1 can be improved. The inclined portions 323*a* may be formed to convexly curve axially upward or axially downward in the axial direction.

The bottom plate portion 31 has a lower projecting piece 310 projecting outward in the radial direction. The lower end of the side wall cutout portion 323 is positioned on the lower projecting piece 310. A lower groove portion 35*a* is formed in the upper surface of the lower projecting piece 310. The lower groove portion 35*a* is recessed axially downward from the upper surface of the lower projecting piece 310 and extends in the radial direction.

The side wall portion 32 has an upper projecting piece 320 that projects outward in the radial direction and faces the lower projecting piece 310 in the axial direction. Specifically, the upper projecting piece 320 projects outward in the radial direction from the side wall projecting portion 324. The upper projecting piece 320 overlaps with the lower projecting piece 310 in the axial direction. An upper groove portion 35*b* is formed in the lower surface of the upper projecting piece 320. The upper groove portion 35*b* is recessed axially upward from the lower surface of the upper projecting piece 320 and extends in the radial direction. In the lead-out port 35, the upper groove portion 35*b* and the lower groove portion 35*a* are formed to face each other in the axial direction and the upper groove portion 35*b* and the lower groove portion 35*a* extend outward in the radial direction.

This allows the lead wires 40 to be held between the lower projecting piece 310 and the upper projecting piece 320, and thus facilitates routing of the lead wires 40 extending to the outside of the casing 30.

The upper projecting piece 320 has a second rib 322 that projects axially upward from the upper surface and is connected to the radially outer surface of the upper wall portion 32*b*. The second rib 322 has an upper end located axially above the upper end of the lower wall portion 32*a* and overlaps with the lead-out port 35 when seen in a plan view. This reinforces the upper projecting piece 320, so that deformation of the upper projecting piece 320 in the axial direction can be prevented. Therefore, deformation of the lead-out port 35 can be prevented and thus damage to the lead wires 40 held in the lead-out port 35 can be prevented.

The upper projecting piece 320 has a pair of projecting piece cutout portions 321 formed by cutouts in both side surfaces in the circumferential direction. The lower projecting piece 310 has a pair of first ribs 311. Each of the first ribs 311 is disposed in one of the projecting piece cutout portions 321, projects axially upward from the upper surface of the lower projecting piece 310, and is connected to the radially outer surface of the lower wall portion 32*a*. The first ribs 311 enforce the lower projecting piece 310, so that deformation of the lower projecting piece 310 in the axial direction can be prevented. In addition, the first ribs 311 prevent deformation due to falling of the lower wall portion 32*a* in the radial direction near the side wall cutout portion 323 when the base portion 30*a* is injection-molded. Therefore, the deformation of the lead-out port 35 can be further prevented.

To the circuit board 227, the plurality of lead wires 40 is connected, and these lead wires 40 are inserted into one tube 41 and are collectively led out from the casing 30 through the lead-out port 35. Further, the lead-out port 35 has ring-shaped lugs 35*c* protruding from the inner peripheral surface toward the lead wires 40, and the plurality of lugs 35*c* is arranged side by side in the radial direction (see FIG. 4). The tube 41 is in contact with the inner peripheral surface of the lead-out port 35 through the lugs 35*c*. This can prevent a gap from being formed between the inner peripheral surface of the lead-out port 35 and the outer peripheral surface of the tube 41. Therefore, it is possible to prevent water, dust, air, and the like from flowing into the duct 50 through the gap.

FIG. 6 is a perspective view illustrating a modification of the casing 30. A base portion 30*a* does not necessarily have a lower wall portion 32*a*. In this case, an upper wall portion 32*b* extends axially downward, and the lower end portion of the upper wall portion 32*b* comes into contact with the upper surface of a bottom plate portion 31. In this case, a side wall cutout portion 323 or a side wall projecting portion 324 is not formed. Therefore, the lead-out port 35 can be formed with a simple structure.

The above-described example embodiments are merely examples of the present disclosure. The configurations of the example embodiments may be appropriately changed within a range not exceeding the technical idea of the present disclosure. In addition, the example embodiments may be implemented in combination within a feasible range.

The present disclosure is applicable to an air blower mounted in, for example, office automation (OA) equipment, medical equipment, a household electric appliance, transportation equipment, and the like.

Features of the above-described preferred example embodiments and the modifications thereof may be combined appropriately as long as no conflict arises.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. An air blower comprising:

an impeller that is rotatable around a central axis extending in a vertical direction;

a motor to rotate the impeller;

at least one lead wire connected to the motor; and a casing that houses the impeller and the motor; wherein the casing includes:

a bottom plate portion that expands in a radial direction from the central axis and holds the motor on an upper surface of the bottom plate portion;

a side wall portion that extends axially upward from an outer peripheral portion of the bottom plate portion; and a top plate portion disposed axially above the impeller and connected to an upper end of the side wall portion;

the casing includes a lead-out port through which the at least one lead wire is led out to an outside of the casing in the radial direction;

the lead-out port includes a lower portion provided on the bottom plate portion and an upper portion provided on the side wall portion, the lower and upper portions being defined by different members;

the bottom plate portion is defined by a first single monolithic structure which includes a lower projecting piece that projects radially outward;

the side wall portion is defined by a second single monolithic structure which includes an upper projecting piece that projects radially outward and axially opposes the lower projecting piece;

the lead-out port includes a lower groove portion defined in an axially upper surface of the lower projecting piece and an upper groove portion defined in an axially lower surface of the upper projecting piece, the upper groove portion and the lower groove portion directly axially opposing each other;

the lower groove portion is located between opposing parallel surfaces defined in the lower projecting piece; and the upper groove portion is located between opposing parallel surfaces defined in the upper projecting piece.

2. The air blower according to claim 1, wherein the lead-out port includes a plurality of ring-shaped lugs protruding from an inner peripheral surface of the lead-out port toward the at least one lead wire; and the plurality of lugs are side by side in the radial direction.

3. The air blower according to claim 1, wherein the bottom plate portion includes a bottom plate recess portion that is recessed axially downward from the upper surface;

the motor includes a circuit board that is disposed in the bottom plate recess portion and includes an upper surface to which the at least one lead wire is connected; and the upper surface of the bottom plate portion that is radially outside the bottom plate recess portion is disposed at a same height or substantially a same height as the upper surface of the circuit board.

4. The air blower according to claim 1, wherein the at least one lead wire includes a plurality of lead wires that are inserted into one tube and collectively led out from the casing through the lead-out port, and the one tube is in contact with an inner peripheral surface of the lead-out port.

5. An air blower, comprising:

an impeller that is rotatable around a central axis extending in a vertical direction;

a motor to rotate the impeller;

at least one lead wire connected to the motor; and a casing that houses the impeller and the motor; wherein the casing includes:

a bottom plate portion that expands in a radial direction from the central axis and holds the motor on an upper surface of the bottom plate portion;

a side wall portion that extends axially upward from an outer peripheral portion of the bottom plate portion; and a top plate portion disposed axially above the impeller and connected to an upper end of the side wall portion;

the casing includes a lead-out port through which the at least one lead wire is led out to an outside of the casing in the radial direction;

the lead-out port includes a lower portion provided on the bottom plate portion and an upper portion provided on the side wall portion, the lower and upper portions being defined by different members;

the bottom olate portion includes a lower projecting piece that projects outward;

the side wall portion includes an upper projecting piece that projects outward in the radial direction and axially faces the lower projecting piece;

the lead-out port includes a lower groove portion in an upper surface of the lower projecting piece and an upper groove portion in a lower surface of the upper projecting piece, the upper and lower groove portions axially facing each other;

the side wall portion is axially divided and includes a lower wall portion connected to the bottom plate portion and an upper wall portion connected to the top plate portion;

in the lower wall portion, a side wall cutout portion is defined to open an upper end of the lower wall portion and a lower end of the side wall cutout portion is on the lower projecting piece;

the upper wall portion includes a side wall projecting portion that projects axially downward and fits into the side wall cutout portion; and the upper projecting piece projects outward in the radial direction from the side wall projecting portion.

6. The air blower according to claim 5, wherein in the upper projecting piece, a pair of projecting piece cutout portions are defined by cutouts in both side surfaces in a circumferential direction; and the lower projecting piece includes a pair of first ribs being disposed in the projecting piece cutout portions, projecting axially upward from an upper surface of the lower projecting piece, and being connected to a radially outer surface of the lower wall portion.

7. The air blower according to claim 6, wherein the lower wall portion includes a pair of inclined portions on both end surfaces facing each other in the circumferential direction with the side wall cutout portion interposed therebetween, the inclined portions being closer to each other at axially lower positions from the upper end.

8. The air blower according to claim 5, wherein the upper projecting piece includes a second rib that projects axially upward from an upper surface of the upper projecting piece and is connected to a radially outer surface of the upper wall portion.

9. The air blower according to claim 8, wherein the second rib includes an upper end located axially above an upper end of the lower wall portion.

10. The air blower according to claim 8, wherein the second rib overlaps with the lead-out port when seen in a plan view.

* * * * *